US007011071B1

(12) United States Patent
Decuir, Jr.

(10) Patent No.: US 7,011,071 B1
(45) Date of Patent: Mar. 14, 2006

(54) INTERNAL BOOST SYSTEM FOR ENGINES

(76) Inventor: Julian A. Decuir, Jr., P.O. Box 720801, Pinon Hills, CA (US) 92372

( * ) Notice: Subject to any disclaimer, the term of this patent is extended or adjusted under 35 U.S.C. 154(b) by 0 days.

(21) Appl. No.: 10/974,369

(22) Filed: Oct. 27, 2004

(51) Int. Cl.
*F02B 33/04* (2006.01)

(52) U.S. Cl. ..... 123/317

(58) Field of Classification Search ..... 123/317, 123/318

See application file for complete search history.

(56) References Cited

U.S. PATENT DOCUMENTS 1,329,038 A 1/1920 Curtiss
3,672,172 A 6/1972 Hammond
3,965,880 A 6/1976 Michael
4,088,097 A * 5/1978 Litz ..... 123/73 AA
6,763,801 B1 * 7/2004 Decuir, Jr. ..... 123/317

* cited by examiner

*Primary Examiner*—Henry C. Yuen
*Assistant Examiner*—Hyder Ali
(74) *Attorney, Agent, or Firm*—Stetina Brunda Garred & Brucker

(57) ABSTRACT

An internal boost system integrated to an engine is provided which includes a blanking plate; a plenum chamber disposed within the oil sump having an exit flange disposed through a side of the oil sump; at least one one-way valve disposed through the blanking plate adapted to allow compressed air flow into the plenum chamber; a plurality of one-way valves disposed through the lower-end of the engine to allow fresh air to be drawn internally into the engine; a fresh air manifold in communication with the plurality of one-way valves disposed through the lower-end of the engine; and an internal boost supply pipe in communication with the plenum chamber exit flange and an air intake manifold of the engine.

30 Claims, 7 Drawing Sheets

INTERNAL BOOST SYSTEM FOR ENGINES

CROSS-REFERENCE TO RELATED APPLICATIONS

The following non-provisional application is related to U.S. Pat. No. 6,763,801 to Decuir, Jr., filed on Dec. 10, 1993, entitled "Internal Combustion Engine Utilizing Internal Boost", the content of which is expressly incorporated by reference herein in its entirety; to U.S. patent application Ser. No. 10/891,914, entitled "Internal Combustion Engine Utilizing Internal Boost", the content of which is expressly incorporated by reference herein in its entirety; and is further related to U.S. Pat. No. 6,044,818 to Decuir, filed on Aug. 26, 1998, entitled "Vibration Dampener for Internal Combustion Engines", the content of which is expressly incorporated by reference herein in its entirety.

STATEMENT RE: FEDERALLY SPONSORED RESEARCH/DEVELOPMENT

Not Applicable

BACKGROUND OF THE INVENTION

1. Field of the Invention

The present invention relates to internal combustion engines in which a compression boost for the fuel-air mixture directed into the intake of the combustion chambers of the cylinders is derived from the backside of the pistons. In particular, the present invention relates to an internal boost system which may be retrofit onto an internal combustion engine or which may be directly incorporated into modern internal combustion engine designs.

2. Background of the Invention

Traditionally, the performance (i.e., horsepower) of internal combustion engines has long been increased by the addition of superchargers or turbochargers. To understand how a supercharger or turbocharger operates, it is helpful to think of an engine as a giant air pump. The engine's four-stroke cycle first allows the pistons to draw air in through the intake manifold and intake valves. The air is then compressed by a piston while all the valves are closed and ignited by the spark plug. The resulting explosion forces the piston down in the power stroke. The final stage of the four-stroke cycle is when the piston comes back up and forces the spent gases out of the exhaust valve.

In theory, a denser air charge (also mixed with fuel) will create a more powerful combustion explosion inside the cylinder, thus creating more downforce on the piston which translates into horsepower. The supercharger or turbochargers act as compressors or air pumps which are capable of increasing the air charge by force feeding air into the combustion chamber thereby creating a denser air/fuel mixture. This mechanically increases the compression ratio by forcing a boosted (pressurized) air/fuel mixture in the combustion chamber. The denser charge increases the dynamic cylinder pressure upon ignition to create more engine power.

Although supercharging and turbocharging technology has evolved into a viable means for producing more horsepower, it does have some drawbacks. Most superchargers are belt driven from the engine itself and can consume up to 20 percent of the engine's total power. On the other hand, since turbochargers are driven from the exhaust of the engine, the turbocharger is exposed to high heat which results in premature wear of the turbocharging system components.

Other less traditional forms for increasing horsepower (i.e. dynamic cylinder pressure) have also evolved such as utilizing the backside of the pistons to compress air in the internal lower cavity of the engine block and routing the compressed air back into the intake system of the engine, thus, increasing the air pressure directed into the combustion chamber similar to that of supercharging or turbocharging.

For example, U.S. Pat. No. 6,763,801 to Decuir [hereinafter "Decuir '801"] teaches an internal combustion engine utilizing internal boost. In particular, Decuir '801 teaches sealing off the internal cavity of an engine by installing a plate 4A, 4B above the oil reservoir creating a plurality of separate internal compression chamber inside the engine. A one-way reed valve 10 is installed into the case of the engine block 2 which allows air to drawn into the internal engine cavity. Additionally, a one-way exit reed valve 11 is installed in the engine block 2 to allow compressed air to be exhausted from the internal engine cavity and to be routed into the engine intake manifold. When the pistons are driven towards the top of the combustion chamber, air from outside the engine is drawn into the internal engine compartment. When the pistons are driven downward, the pressure inside the chamber is increased and air is forced outside the block through the exit reed valve 11. The exiting air is then directed into the intake of the engine to boost the dynamic cylinder pressure upon ignition to create more engine power.

Even though internal boost technology appears to be a viable source of "free" horsepower (i.e. non-parasitic) as compared to supercharging technology, internal boost technology is still relatively in its infancy stage with regard to development. Since the aforementioned Decuir '801 patent was filed, engine technology has steadily been advancing. The Decuir '801 teaching is based upon an air-cooled VOLKWAGEN engine which is a flat horizontally opposed four cylinder engine in which there are two banks of cylinders (two cylinders per bank). This engine configuration dates back to pre-World War II technology developed in Germany. Although, this "VW" engine is famous for its simplicity and reliability, it has since been passed up for more modern water cooled inline four and six cylinder engine configurations and for V-configured engines (e.g., V6, V8, V10, etc.). Furthermore, since the Decuir '801 patent has been filed, the aforementioned engines have also significantly evolved incorporating many modern engine manufacturing and design concepts. For instance, state of the art engine blocks may no longer be heavy one-piece unit casts from iron. Instead, the engine manufacturers have adopted highly refined "modular" engine platforms which utilize light weight cast components such as unitary lower main journal plates (instead of individual journal caps), engine front covers, and cast oil plans (instead of steel stamped or pressed oil pans).

It would be beneficial to incorporate internal boost technology into more modern engine platforms. Moreover, it would be advantageous to provide an internal boost system which is simple to manufacture and of which utilizes few parts. An ideal internal boost system could either be integrated into modern modular engine platforms, or retrofit onto existing traditional cast engines.

BRIEF SUMMARY OF THE INVENTION

According to one embodiment of the present invention, an internal boost system integrated to an engine is provided for improving horsepower while further being capable of reducing emissions. The internal boost system is adapted derive an internal compression boost from the backside of the pistons. In particular, the present invention may be retrofit onto an internal combustion engine or which may be directly incorporated into modern internal combustion engine designs.

In a preferred exemplary embodiment of the present invention, the internal boost system is integrated into an internal combustion engine. An exemplary engine may comprise an engine block including at least one in-line bank of cylinders having an upper-end, and a plurality of upper interior journal walls transversely positioned across a lower-end of the block, each wall including an upper main bearing journal for receiving a crankshaft; a piston having a topside and backside disposed within each cylinder; a crankshaft disposed within the upper main bearing journals; a connecting rod interconnecting the crankshaft to each respective piston; a cylinder head attached to the upper end of the bank of cylinders such that a combustion chamber is defined between the topside of each piston, the cylinders, and the cylinder head; an oil sump having a flange attached to an opening in the lower-end of the engine, the opening exposed to an internal cavity of the engine; and an air intake manifold in communication with each combustion chamber; and According to another aspect of the present invention, an internal boost system integrated into the engine includes a blanking plate installed between the opening of the lower-end of the engine and the flange of the oil sump; a plenum chamber disposed within the oil sump having an exit flange disposed through a side of the oil sump; at least one one-way valve disposed through the blanking plate adapted to allow compressed air flow into the plenum chamber; a plurality of one-way valves disposed through the lower-end of the engine to allow fresh air to be drawn internally into the engine; a fresh air manifold in communication with the plurality of one-way valves disposed through the lower-end of the engine; and an internal boost supply pipe in communication with the plenum chamber exit flange and an air intake manifold of the engine.

According to an aspect of the present invention, the backsides of pistons, lower main journal walls from the lower-end of the engine, and a topside of the blanking plate form an internal compression chamber within the lower-end of the engine for each respective piston; fresh air is drawn into a respective internal compression chamber for each respective piston when each piston is moved upward and compressed by the backside of the piston when the piston is pushed downward; and the compressed air flows through a respective one of the plurality of one-way valves into the plenum chamber, flows through the internal boost supply pipe, and then flows into the air intake manifold to provide a boost in pressure within compression chambers of the engine.

According to another aspect of the present invention, the engine is a V-configured engine comprising one of a V-6, V-8, V-10 and V-12, or the engine may be an in-line configured engine.

According to still another aspect of the present invention, the blanking plate is integrally formed to the oil sump wherein the blanking plate includes oil drain passages internally disposed within the plate for draining oil into the oil sump.

Furthermore, other aspects of the present invention includes a unitary lower main journal plate adapted to mount to the lower-end of the engine, the lower main journal plate defined by a generally upright perimeter wall conforming to the lower-end of the block, and lower journal walls transversely positioned across the journal plate, each wall including a semicircular lower main bearing journal for receiving a crankshaft. Also, the unitary lower main journal plate may include a lower main journal bearing journal oiling system having an oil supply passage to each journal and a return passage from each journal disposed internally within the unitary main journal plate.

Moreover, according to another aspect of the preferred embodiment of the present invention the engine lubrication system utilizes a wet sump system. Yet in another alternative embodiment of the present invention, the engine utilize a dry sump lubrication system wherein the dry sump lubrication system is adapted scavenge oil from the oil sump and oil from downstream the collector plenum.

According to yet another aspect of the present invention, the one-way valves are reed valves. Also a check-valve may be including downstream of the exist flange to prevent backflow into the plenum chamber. Additionally, the present invention may utilize a first oil separator baffle positioned upstream the at least one-way valve disposed through the blanking plate and a second oil separator baffle for removing pooling oil from the plenum chamber.

Other exemplary embodiments and advantages of the present invention may be ascertained by reviewing the present disclosure and the accompanying drawings.

BRIEF DESCRIPTION OF THE DRAWINGS

The present invention is further described in the detailed description that follows, by reference to the noted drawings by way of non-limiting examples of preferred embodiments of the present invention, in which like reference numerals represent similar parts throughout several views of the drawings, and in which.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Prior Art Modern Internal Combustion Engine

Figure 1:
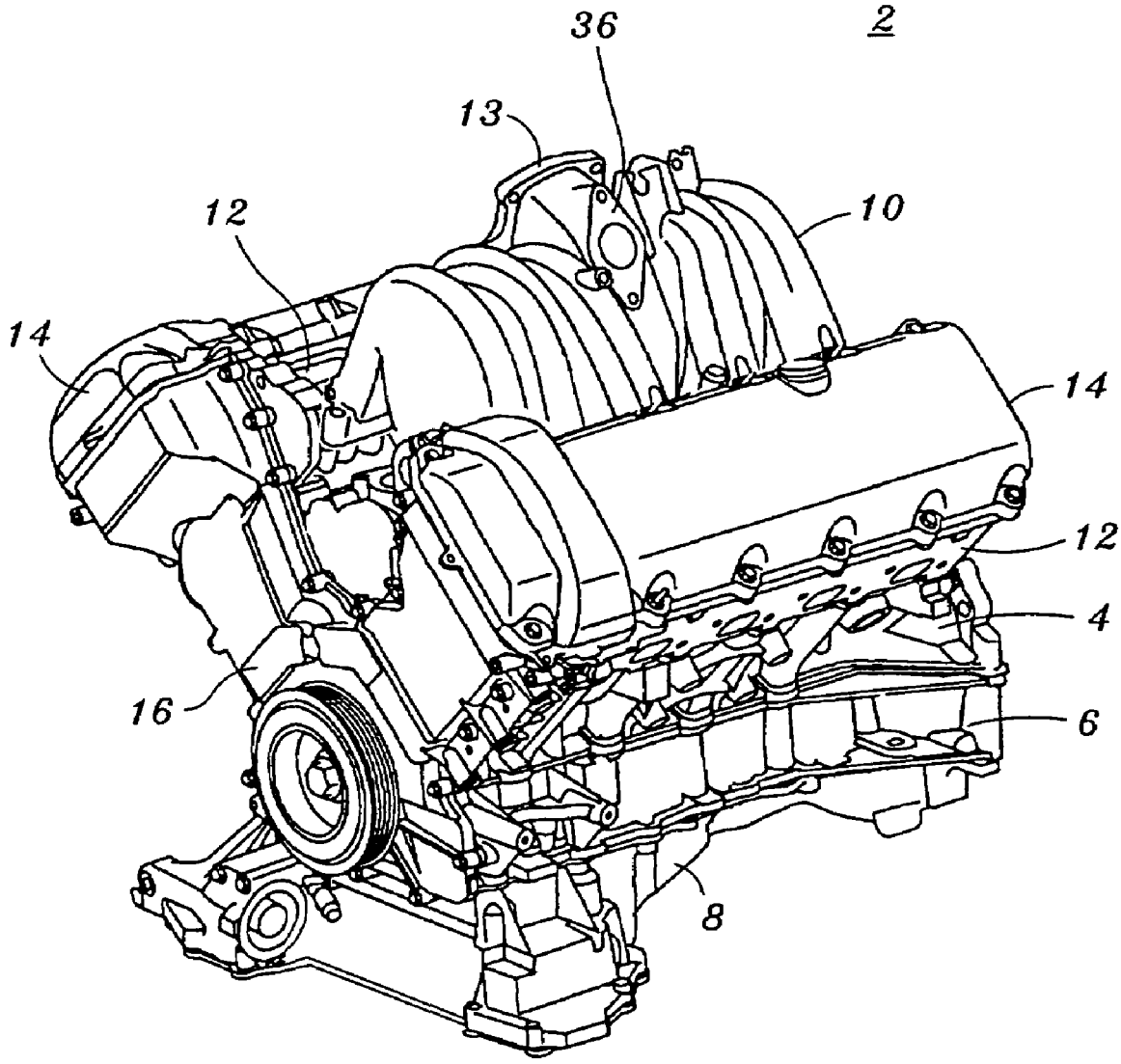
Fig. 1 (PRIOR ART)
FIG. 1 shows an exemplary V-configured internal combustion engine (prior art)
Figure 2:
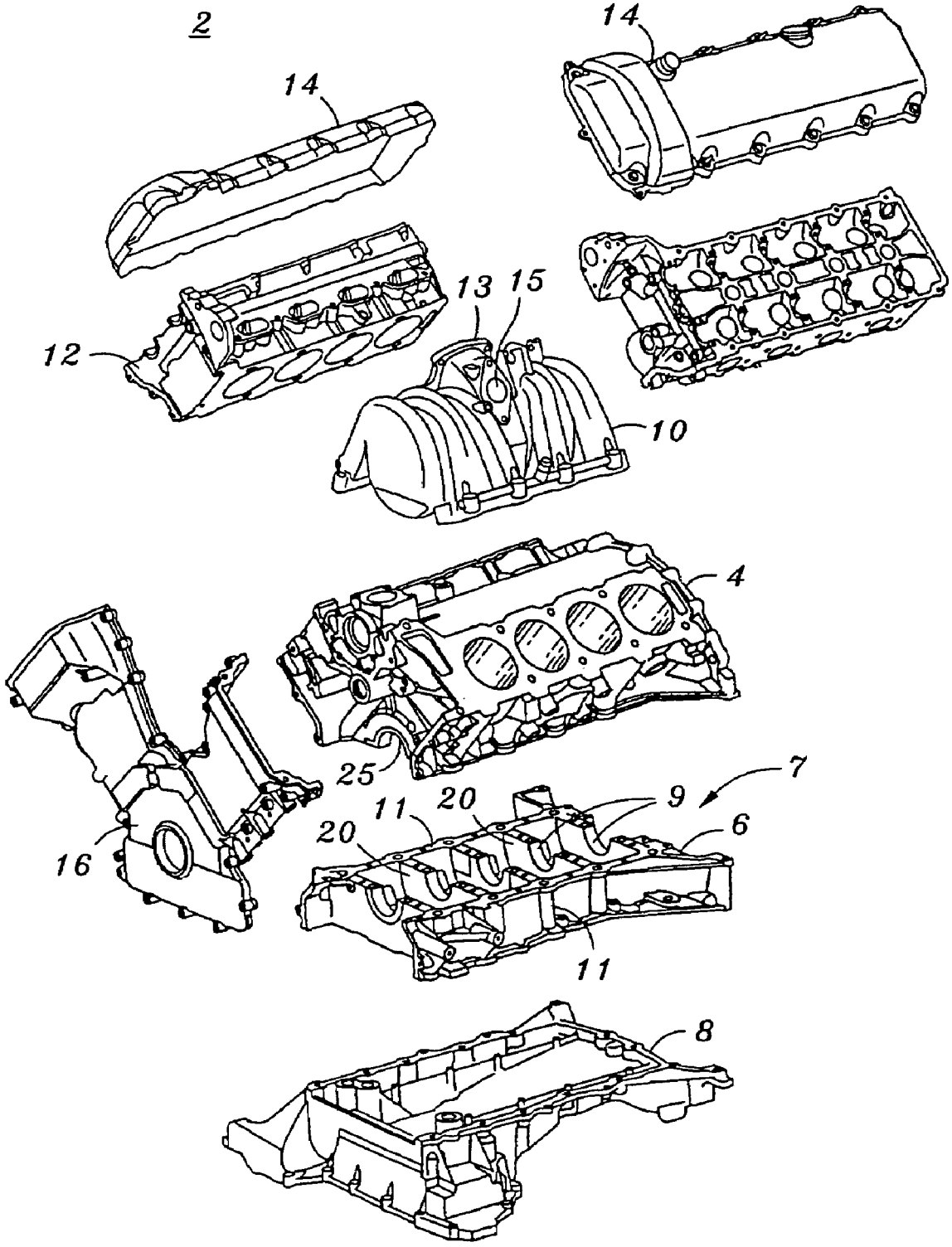
Fig. 2 (PRIOR ART)
FIG. 2 shows an exploded perspective view of the internal combustion engine from FIG. 1 (prior art)

FIG. 1 shows an exemplary V-configured conventional internal combustion engine assembly 2, while FIG. 2 shows an exploded perspective view of the same engine assembly 2. The main components of the engine assembly 2 include an engine block 4, a unitary lower main journal plate 6, a wet oil sump or oil pan 8, front end cover plate 16, intake manifold 10, cylinder heads 12 and valve covers 14. The unitary lower main journal plate 6 includes a plurality of journal walls 27 transversely oriented between longitudinal sidewalls 11 defining the lower main journal plate 6. Each transversely oriented journal wall 27 includes a lower main crankshaft bearing journal 9 adapted to receive a crankshaft (not shown). It is noted that many less modern engine blocks utilize separate bearing journals which are bolted directly to the lower end of an engine block. Thus, many engines do not have a unitary lower main journal plate 6 as is shown in FIGS. 1 and 2.

Exemplary Internal Boost System Adapted for a Modern Internal Combustion Engine

Figure 3:
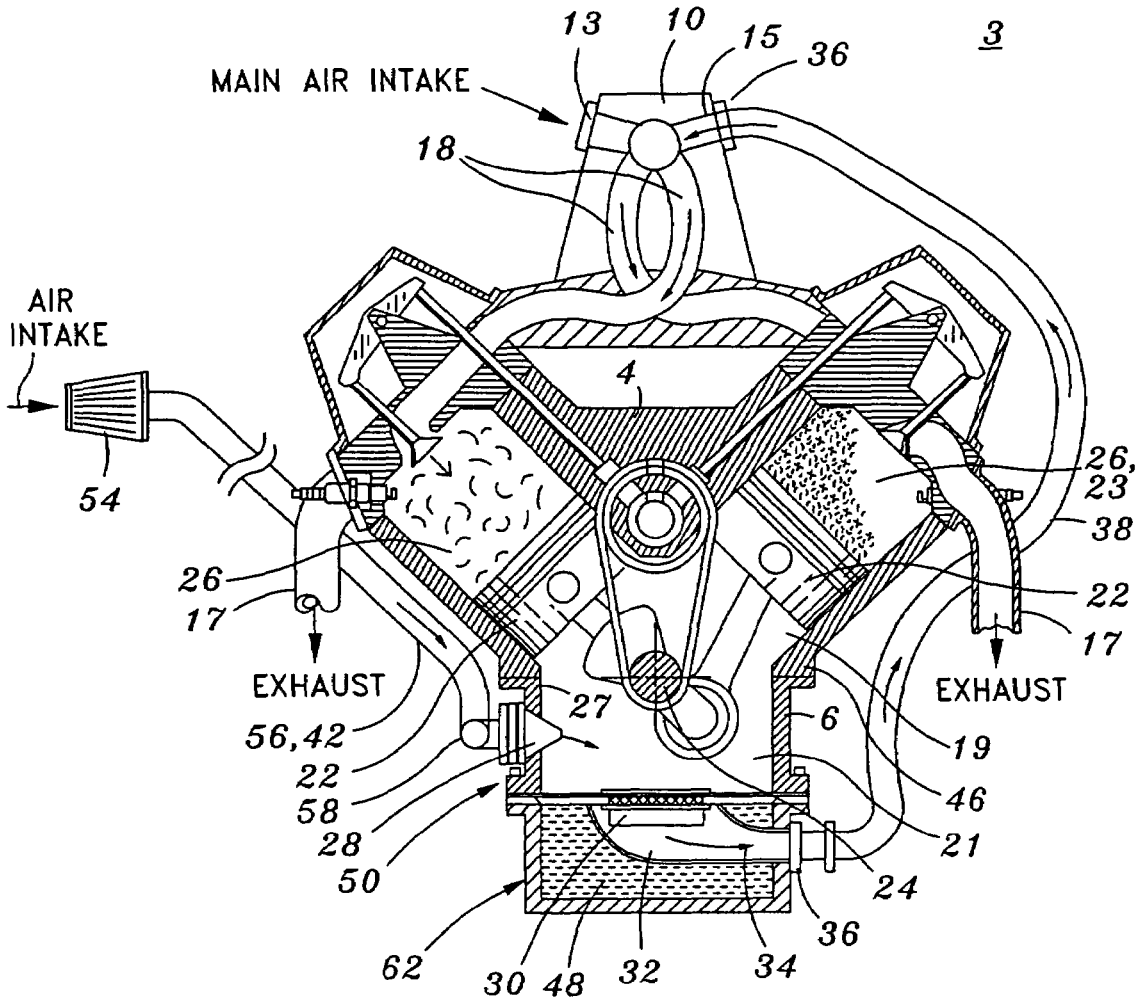
FIG. 3 shows a cross-sectional of a V-configured internal combustion engine with an internal boost system, according to an aspect of the present invention.

FIG. 3 shows a cross-sectional schematic an exemplary V-configured engine 2 with an internal boost system 3, according to an aspect of a first preferred embodiment of present invention. In the first embodiment, the internal boost system 3 may be either integrated directly into a conventional engine 2 or retrofit onto an existing conventional engine 2. In this preferred embodiment of the present invention, the conventional engine utilizes a conventional wet sump 62 which has been modified (see FIG. 5) with an internal boost plenum chamber 32, the details of which will be discussed later in the specification.

In the preferred embodiment, the internal boost system may comprise a fresh air manifold assembly 42, a modified unitary lower main journal plate 50, an optional gasket 40, a modified wet oil sump or oil pan 62, and an internal boost pipe 38. The present invention utilizes the backside of the pistons 22 during the down-stroke portion of the piston movement cycle to compress air within the engine's internal compartment or cavity 19 and lower-end 21, and then redirect the compressed internal cavity air through the internal boost plenum chamber 32. From the internal boost plenum chamber 32, the compressed air is directed through the internal boost supply pipe 38 and into the intake manifold 10 of the engine. Therefore, the pressure in which the air-fuel mixture is forced into the combustion chambers 26 is raised, which increases horsepower while sometimes even reducing emissions as a side-effect. The aforementioned exemplary components of the internal boost system 3 for modern internal combustion engines 2 are now herein further discussed below.

Figure 4:
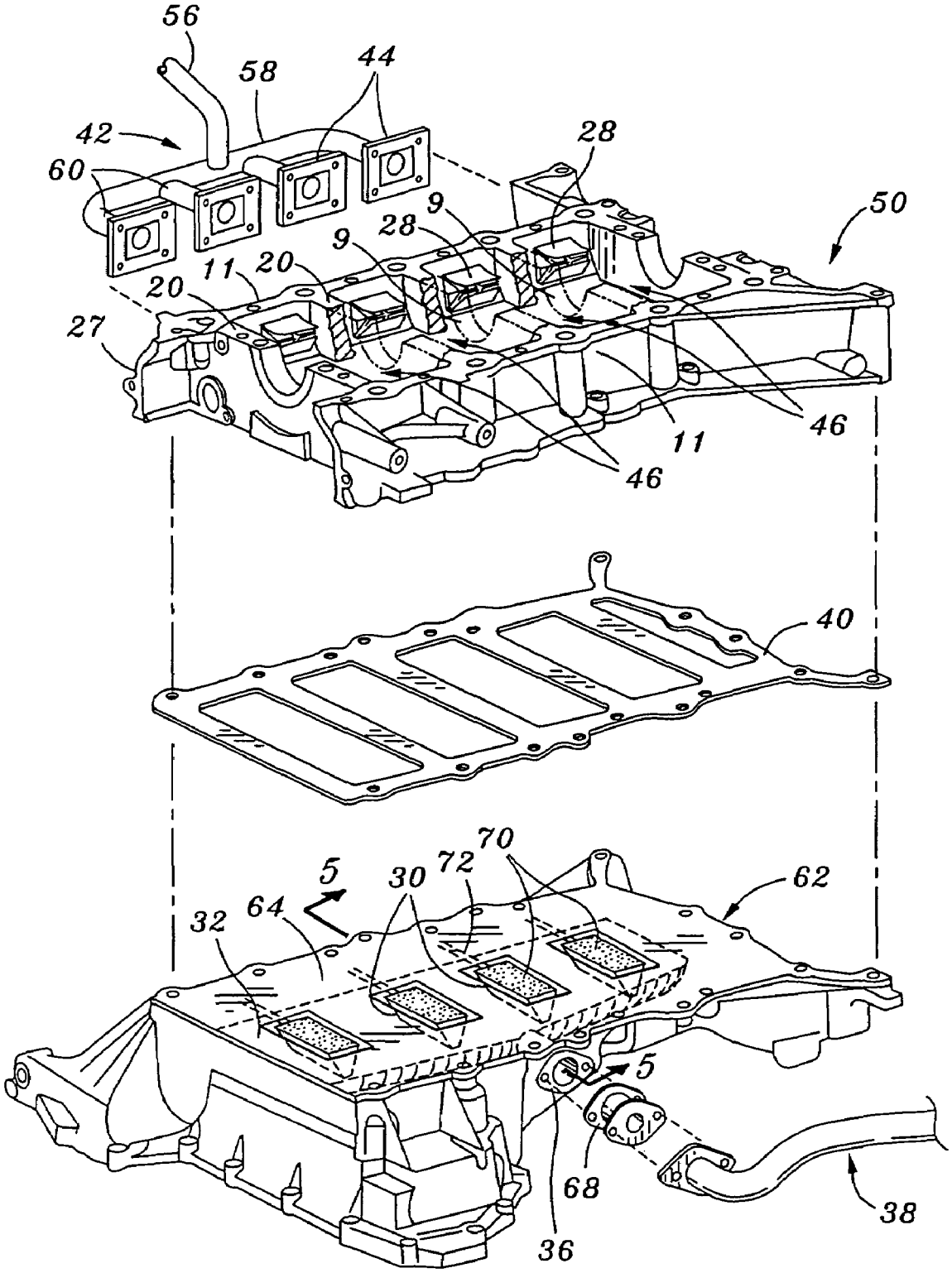
FIG. 4 shows an exploded perspective of components of the internal boost system from FIG. 3, according to an aspect of the present invention.

FIG. 4 shows an exploded perspective of components of the internal boost system from FIG. 3, according to an aspect of the present invention. The exemplary fresh air manifold 42 functions as a conduit which provides fresh air into the engine's internal compartment or cavity 19. The manifold 42 may be fabricated from tubing or any other material known in the art which is suitable for routing fresh air into an engine. In one embodiment, the fresh air manifold 42 may include a first inlet tube 56 which connects to a second distributed manifold 58 having a plurality of flanges 44 attached to individual legs of the distributed manifold 58. The flanges 44 are adapted to attach to either one of the upright perimeter wall 27 of the modified unitary lower main journal plate 50 or the outer face plates of a one-way valve means 28 which is disposed through the upright perimeter wall 27. The distributed manifold 58 may include a plurality of legs 60 which each individually supply fresh air to each separated internal compression chamber 46 which is described in greater detail later in the specification. It is further noted that an air filter housing and element 54 may be connected to the distal inlet end of the fresh air inlet tube 56. The air filter housing and element 54 may be positioned in an area of the vehicle which receives fresh air, such as near the grill, in a forced air opening (air vent), or upwardly positioned in the engine compartment.

Another component utilized in the first exemplary embodiment of the internal boost system 3 is the modified unitary lower main journal plate 50. The journal plate 50 is essentially the same component as the stock unitary lower main journal plate 7, except for a modification which incorporates a plurality of one-way valve means 28 into the upright perimeter wall 27 of the modified unitary lower main journal plate 50 such that fresh air from the fresh air manifold assembly 42 may be drawn into the engine's internal compartment or cavity 19 without backflow of the air through the one-way valve means 28. Thus, the stock journal plate 7 may be converted into a modified journal plate 50, or a new modified journal plate 50 may be fabricated from scratch which has the same basic dimensions of the stock journal plate 7, except for the addition of the modifications which include the addition of a plurality of one one-way valve means 28.

The one-way valve means 28 may comprise of any device which allows gas to flow in one direction into the engine's internal cavity 19. Such one-way valve means 28 preferably is a reed valve, but it is understood that the one-way valve means 28 may also be a check valve, one-way valve or any other device which functions in a similar manner (i.e., allowing gas to flow in only one direction). Furthermore, it is understood that the aforementioned examples are not a comprehensive list, and that any equivalent one-way valve means 28 may be used with the present invention. As best shown in FIG. 4, the one-way valve means 28 are installed into the upright perimeter wall 27, and more particularly one of the longitudinal sidewalls 11 of the modified journal plate 50. Thus, if the stock unitary lower main journal plate 7 is used in the internal boost system 3, a hole must be cut into the longitudinal sidewalls 11 of the stock journal plate 50 to accommodate the one-way valve means 28.

The present invention further utilizes separated internal compression chambers 46 which are formed between the lower journal walls 20 (see also FIG. 7) of the modified plate 50 and upper journal walls formed inside the engine block 4 lower-end 21 (not shown). Thus, for the exemplary engine 2 in which the internal boost system 3 is adapted thereto, the engine's internal cavity 19 and modified plate 50 is separated into four internal compression chambers (via lower journal walls 20 and the upper journal walls) which are in communication with the backsides of two opposing pistons 22. In particular, in the exemplary first embodiment, four separated internal compression chambers 46 are formed when the modified journal plate 50 is bolted to the lower-end 21 of the engine block 4 and when the modified oil sump 62 and blanking plate 64 is positioned between to the bottom of the modified journal plate 50 and the top of the modified oil sump 62. Thus, each internal compression chamber 46 is assigned to two opposing pistons 22 and cylinders 23 (i.e., one piston and cylinder from the leftside bank of pistons/cylinders and one piston and cylinder from the rightside bank of pistons/cylinders). By using the upper journal walls from the lower-end 21 of the engine 4, the lower journal wall 20 from the journal plate 50, and the blanking plate 64 from the modified oil pan or oil sump 62 (discussed in greater detail below), a plurality of separated internal compression chambers 46 may be provided for each pair of opposing cylinders/pistons, the function of which will be described later in the specification.

FIG. 4 shows an exemplary modified oil pan or oil sump 62 according to an aspect of the first exemplary embodiment. As noted earlier, the preferred embodiment of the present invention utilizes a wet sump system of which oil sump 62 facilitates such function. The modified oil sump 62 may be fabricated from the stock oil pan or sump 8 or may be manufactured from scratch. In one embodiment of the present invention, modified oil sump 62 includes a blanking plate 64 integrally formed to the top surface of the oil sump 62 which acts as the bottom surface of the internal compression chambers. In another alternative embodiment of the present invention, the blanking plate 64 and internal boost plenum chamber 32 are separate and detachable from the modified oil sump 50. When the modified oil sump 62 and blanking plate 64 is bolted to the bottom of the modified journal plate 50 (optionally using the gasket 40), the blanking plate 64 acts to seal off the bottom of the journal plate 50, therefore, forming the bottom surface of separated internal compression chambers 46.

Additionally, the modified oil sump 32 includes an internal boost plenum chamber 32 which is adapted to receive the compressed air from the separated internal compression chambers 46. Moreover, the internal boost plenum chamber 32 is adapted to keep the compressed air derived from the back surfaces of the pistons 22 separate from the oil contained in the oil sump 62. Further details of the oiling system in the engine 2 will be discussed in further detail later in the specification. Disposed through the blanking plate 64 are a plurality of one one-way valve means 30 which allow the compressed air from the separated internal compression chambers 46 to enter into the internal boost plenum chamber 32. The one-way valve means 32 may comprise of any device which allows gas to flow in the internal boost chamber 32 in one direction. Such one-way valve means 32 preferably is a reed valve, but it is understood that the one-way valve means 32 may also be a check valve, one-way valve or any other device which functions in a similar manner. Furthermore, it is understood that the aforementioned examples are not a comprehensive list, and that any equivalent one-way valve means 32 may be used with the present invention.

Figure 5:
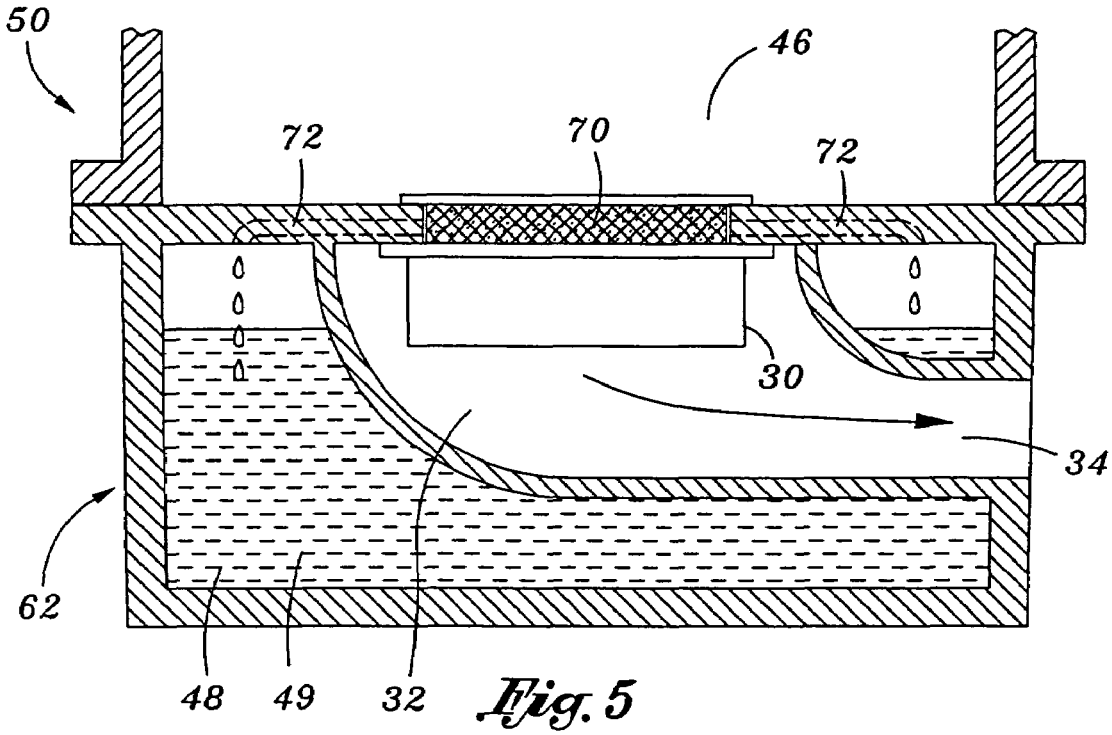
FIG. 5 shows a cross-sectional perspective of a modified wet sump embodiment, according to an aspect of the present invention.

FIG. 5 shows a cross-sectional perspective of the modified oil pan or sump 62, and in particular, the internal boost plenum chamber 32, collector plenum 34, and oil containment section 49, according to an aspect of the present invention. The internal boost plenum chamber 32 is a separate chamber which receives the compressed air from the back of the pistons 22. The shape of the internal boost plenum chamber 32 may take any form which effectively (i.e., fluid dynamically) receives air from the separated internal compression chambers 46 and routes it through the collector plenum 34 which then directs the internal boost through the internal boost supply pipe 38. As can be seen in FIGS. 3 and 4, the modified oil sump 62 includes an exit port and flange 36 which is adapted to discharge the internal boost compressed air into the boost supply pipe 38. An optional check-valve 68, may be installed after the exit port and flange 36 to prevent any backflow of gases into the engine (see FIG. 4).

Another feature provided on the modified oil sump 62 is the oil separator/baffle feature 70 which separates oil which has pooled on the top surface of the blanking plate 64 of the modified oil pan 62. Although the oiling system of the present invention is designed to prevent excessively splashing and drainage into the internal compression chambers 46, including the engine's lower-end 21 and internal cavity 19, oil may still at the blanking plate 64. And so that oil does not flow into the internal boost plenum chamber 32, a separator/baffle feature 70 may be installed over the inlet of the one-way valves means 30. Furthermore, a plurality of oil drain passages 72 are internally formed within the blanking plate 64. The oil drain passages include an inlet port 73 which is in communication with the separator/baffle feature 70. Further, a drain port 74 is provided on the bottom side of the blanking plate which drains into the oil containment section 49 of the modified oil sump 62. When oil accumulates inside the oil separator/baffle 70 feature, it is routed (preferably by vacuum from the oil containment section 49 into the modified oil pan 62 via blanking plate oil drainage passages 72.

Preferred Exemplary Wet Sump System

Figure 7:
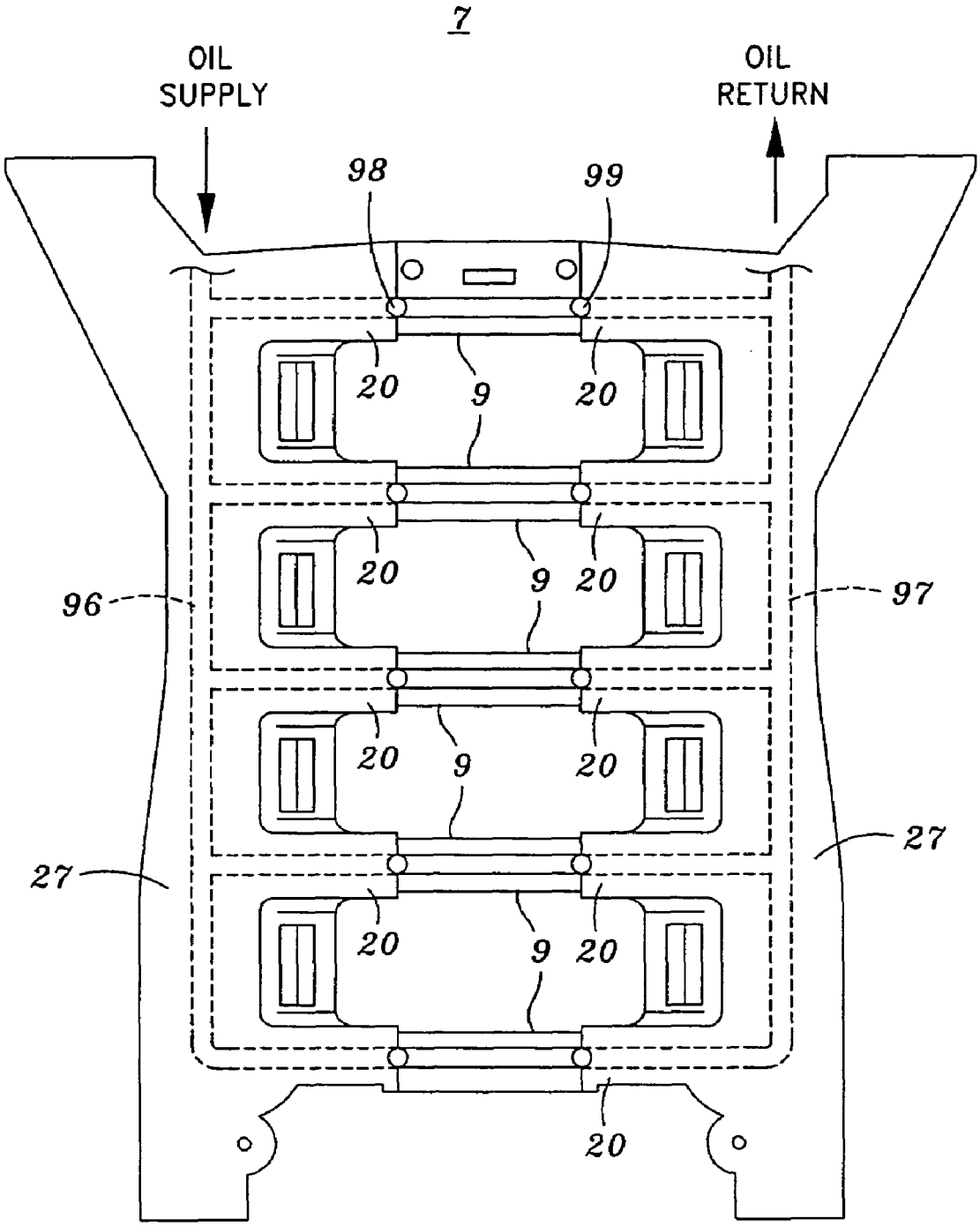
FIG. 7 shows a top view of the unitary lower main journal plate and the lower main bearing journal oiling system, according to an aspect of the present invention.
Figure 8:
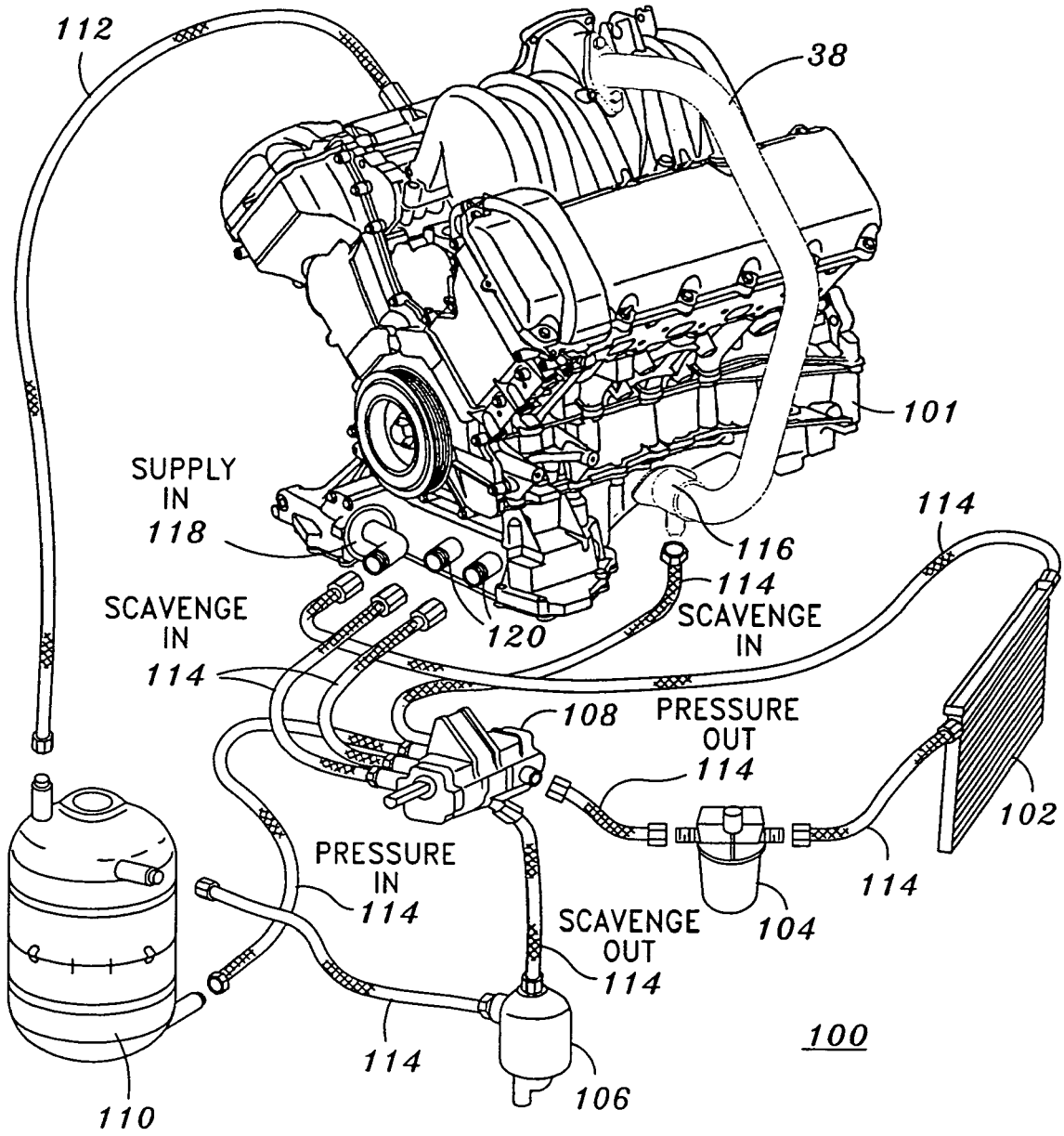
FIG. 8 shows an alternative dry sump embodiment, according to an aspect of the present invention.

One aspect of the present invention is that the engine 2 with the internal boost system 2 may use either (1) a conventional wet sump system with a modified oil pan 62 (see FIGS. 3–7) or in the alternative, a dry sump system (see FIG. 8). The wet sump oiling/lubrication system is now herein discussed below.

Preferably, the present invention utilizes a conventional wet sump system with modified oil pan 62 as shown in FIGS. 3 through 7. The oil containment section 49 of the modified oil pan 62 is adapted to function as a wet sump, and in particular, contain the oil necessary to properly lubricate the engine 2. Thus, in this case, the engine 2 may use standard oiling/lubrication features provided in conventional engines, such as an oil pump which circulates oil through various oil passages through the engine block 4.

However, in an effort to minimize mixing oil particulates (i.e., atomization) with the internally compressed air, the present invention utilizes a plurality of additional oiling/lubrication passages. In particular, one aspect of the present invention reduces conventional oil splashing techniques within the internal cavity 19 of the engine 2 in exchange for the incorporation of oiling/lubrication passages which are not traditionally found in conventional modern engines. This is particularly useful for the reduction of emissions from the internal boost source of pressure derived in the plurality of separated internal boost compression chambers 46. The manner in which the oil splashing is replaced with oiling/lubrication passages in now herein described below.

Figure 6:
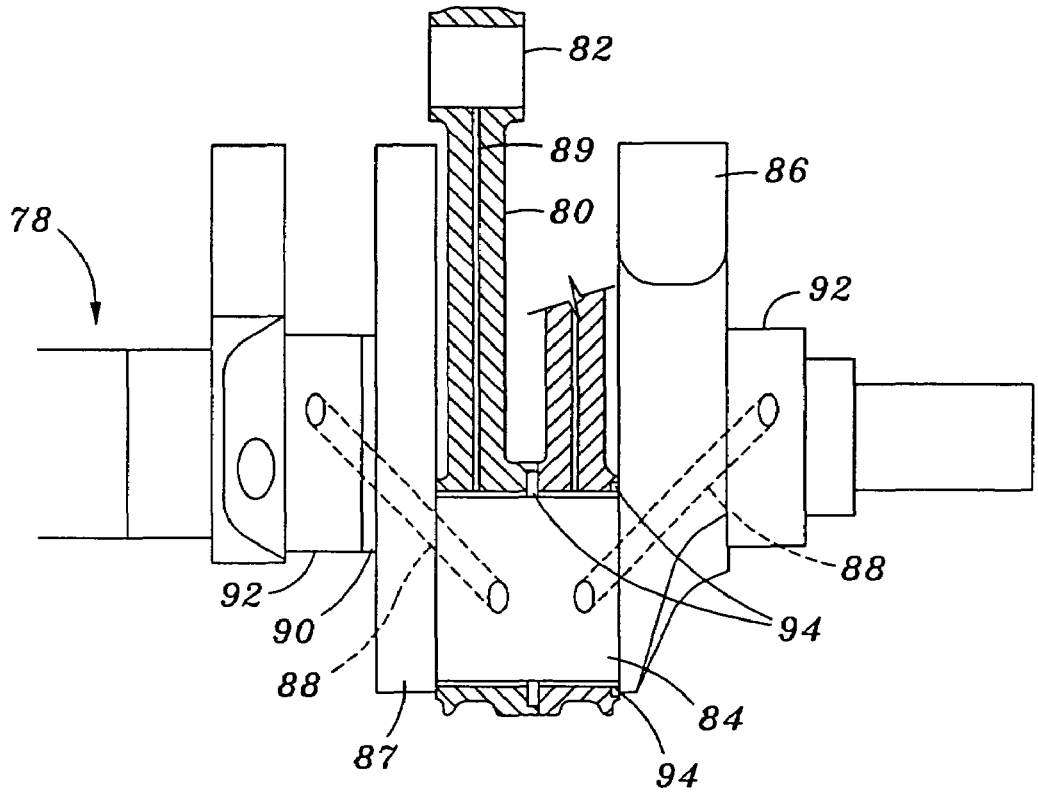
FIG. 6 shows a partial view of the crankshaft, and a cross-sectional detail view of exemplary connecting rods with a wrist pin and piston oiling system, according to an aspect of the present invention.

FIG. 6 shows a partial view of an exemplary crankshaft 78, and a cross-sectional detail view of exemplary connecting rods 80 with a wrist pin and piston oiling system, according to an aspect of the present invention. Preferably, the vibration dampener and wrist pin and piston oiling system taught in U.S. Pat. No. 6,044,818 to Decuir, filed on Aug. 26, 1998, entitled "Vibration Dampener for Internal Combustion Engines", is utilized in the present invention. In particular, the oil may be supplied through oil supply passages within the engine block 4, and through passages disposed in the lower-end 21 of the engine 2. The oil is then directed by oil passages disposed within the upper journal walls (not shown) disposed in the lower-end of the engine block 4 to provide lubrication to the upper main journals 25 (see FIG. 2). Moreover, oil is supplied via passages disposed internally within the lower-end of the engine block 4 to the unitary lower main plate 7, which in turn has oiling passages 96, 97 which directs oil to and from the lower main journals 9. Thus, sufficient oil may be circulated to the upper and lower main journals 25, 9. More details of this portion of the oiling system are described later in the specification.

Oil from the lower and upper main journals 9, 25 is then directed through the crankshaft main journals 92 (which rotate within the lower and upper main journals 9, 25). The oil is then picked up and directed through crankshaft oil passages 88 where it flows onto the crankshaft connecting rod journal 84 of the crankshaft 78. The oil is then routed upwards through the wrist pin and piston oiling passageway 89 which is disposed internally in the connecting rod 80. With this configuration, sufficient oil may then be provided to the wrist pin (not shown) which connects the piston 22 (not shown) to the connecting rod 80. Further, sufficient oil may be also then supplied to the piston 22 for lubricating the cylinders walls. By utilizing the aforementioned oiling/lubrication system, the amount of oil splashed internally within the internal engine cavity may be sufficiently reduced, therefore, inhibiting the mixture or atomization of the oil with the fresh air being drawn into the internal compression chambers 46 of the engine 2, which is eventually compressed by the backside of the pistons 22.

Additionally, the present invention preferably implements the vibration dampener technology taught in U.S. Pat. No. 6,044,818 to Decuir, filed on Aug. 26, 1998, Entitled "Vibration Dampener for Internal Combustion Engines". Thus, a vibrational dampener 90 may be disposed between the crankshaft main journal 92 and the counter weight 87 of the crankshaft 78. Moreover, vibrational dampeners 94 are further disposed between the connecting rods 80 and the counterweight 86.

FIG. 7 shows a top view of the unitary lower main journal plate 7 and the lower main bearing journal oiling system 96–99, according to an aspect of the present invention. In particular, the lower main bearing journal oiling system comprises oil supply passage 96 and oil return passage 97 disposed internally within the unitary lower main journal plate 7. The passages 96, 97 are routed through the lower journal walls 20 in which the lower main journals 9 are disposed. The supply passage 96 then provides oil to supply port 98 which opens up at the surface of the lower main journal 9. The oil return passage 97 then withdraws oil at the return port 99 which also opens up on the surface of the lower main journal 9.

Alternative Dry Sump System

FIG. 8 shows an alternative embodiment of the present invention which utilizes a dry sump oil system 100. A modified oil pan 101 is provided which is similar to the same modified oil pan 62 used on the wet sump system described above (see FIG. 4), except a plurality of oil drain ports 120 are further integrated into the modified oil pan 100. Moreover a supply fitting/adaptor 118 may be installed onto the stock oil filter fitting. The dry sump oil sump system 100 may further include an oil tank 110, a pump assembly 108 (which may have multiple stages), a screen type filter 106, and a flow filter 104, an oil cooling radiator 102, and a second stage oil filter/baffle 116 (instead of the check valve 68 from FIG. 4). Furthermore, the dry sump oil system utilizes various oil lines 114 and 112.

The manner in which the dry sump operates is similar to dry sump systems installed on conventional engines without the internal boost system 3. The pump assembly 108 in the instant alternative embodiment is a four-stage pump which includes three ports for scavenging oil out of the engine 2, one port for scavenging oil out of the pump 108, one port for pumping oil out, and another port for receiving oil from the reservoir 10. In particular, oil is pumped out of the pump 108 through flow filter 104, into oil cooling radiator 102, and into the modified oil pan 101 at supply fitting/adaptor 118. Oil is drained from the dry sump modified oil pan 101 at ports 120 by a plurality of scavenging lines 114. Furthermore, a third scavenging line to withdraw potentially pooling oil in the internal boost plenum 32. In particular, an optional second stage oil separation baffle 116 may be installed at the exit flange 36 which allows the third scavenging line to remove potential oil pooling out of the internal boost plenum 32. Additionally, oil is scavenged out of the multistage pump 108 and circulated through a screen type filter before the oil is routed into an oil tank or reservoir 110. The oil reservoir then supplies oil under pressure back to the oil pump 108. Optionally, a breather hose 112 may be connected to a breather mounted on top of the valve covers 14. It is recognized that the aforementioned dry sump oil system 100 depicted in Figure is merely exemplary, and that various dry sump approaches are well-known in the art and therefore, could also be utilized on the present invention.

Other General Information about the Present Invention

It is also noted that for exemplary purposes only, a modern modular V-8 engine has been retrofitted with the internal boost system 3. However, it is understood, the present invention may be integrated directly into, or retro fit thereon any conventional internal combustion engine, for example, in-line 4, 6 and 8 cylinders engines, or V-6, V-8, V-10 or V-12 configured engines. Thus, the present invention is not limited to exemplary Figures presented in this description. Rather, the Figures are merely an example of one engine application in which the internal boost system has been installed.

It is further noted that in other embodiments, such as V-6's, V-10's or V-12's, the number of internal compression chambers is determined by the number of pistons divided by two. For instance, a V-6 would have three internal compression chambers, while a V-10 would have five internal compression chambers. Furthermore, an inline engine, would only have one internal compression chamber per cylinder, since there is only one bank of cylinders. For example, an in-line four cylinder engine would have four internal compression chambers, while an in-line six cylinder engine would have six internal compression chambers.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed; rather, the invention extends to all functionally equivalent structures, methods, and such uses are within the scope of the appended claims.

What is claimed is:

1. An internal boost system integrated to an engine, the internal boost system comprising:

a blanking plate adapted to be positioned between a lower-end of the engine and an oil sump;

a plenum chamber disposed within the oil sump having an exit flange disposed through a side of the oil sump;

at least one one-way valve disposed through the blanking plate adapted to allow compressed air flow into the plenum chamber;

a plurality of one-way valves disposed through the lower-end of the engine to allow fresh air to be drawn internally into the engine;

a fresh air manifold in communication with the plurality of one-way valves disposed through the lower-end of the engine; and an internal boost supply pipe in communication with the plenum chamber exit flange and an air intake manifold of the engine;

wherein backsides of pistons, lower main journal walls from the lower-end of the engine, and a topside of the blanking plate form an internal compression chamber within the lower-end of the engine for each respective piston;

wherein fresh air is drawn into a respective internal compression chamber for each respective piston when each piston is moved upward and compressed by the backside of the piston when the piston is pushed downward; and wherein the compressed air flows through a respective one of the plurality of one-way valves into the plenum chamber, flows through the internal boost supply pipe, and then flows into the air intake manifold to provide a boost in pressure within compression chambers of the engine.

2. The system of claim 1, wherein the engine is a V-configured engine comprising one of a V-6, V-8, V-10 and V-12.

3. The system of claim 1, wherein the internal combustion engine is an in-line configured engine.

4. The system of claim 1, wherein the blanking plate is integrally formed to the oil sump.

5. The system of claim 1, wherein the blanking plate includes oil drain passages internally disposed within the plate for draining oil into the oil sump.

6. The system of claim 1, wherein the engine includes a unitary lower main journal plate adapted to mount to the lower-end of the engine, the lower main journal plate defined by a generally upright perimeter wall conforming to the lower-end of the block, and lower journal walls transversely positioned across the journal plate, each wall including a semicircular lower main bearing journal for receiving a crankshaft.

7. The system of claim 1, the unitary lower main journal plate including a lower main journal bearing journal oiling system having an oil supply passage to each journal and a return passage from each journal disposed internally within the unitary main journal plate.

8. The system of claim 1, wherein the engine lubrication system utilizes a wet sump system.

9. The system of claim 1, further including a dry sump lubrication system.

10. The system of claim 9, wherein the dry sump lubrication system is adapted scavenge oil from the oil sump.

11. The system of claim 10, wherein the dry sump lubrication system is adapted to scavenge oil from downstream the collector plenum.

12. The system of claim 1, wherein the one-way valves are reed valves.

13. The system of claim 1, further including a check-valve downstream of the exist flange to prevent backflow into the plenum chamber.

14. The system of claim 1, further including a first oil separator baffle positioned upstream the at least one-way valve disposed through the blanking plate.

15. The system of claim 1, further including a second oil separator baffle for removing pooling oil from the plenum chamber.

16. An internal combustion engine having an internal boost system, comprising:

an internal combustion engine comprising, an engine block including at least one in-line bank of cylinders having an upper-end, and a plurality of upper interior journal walls transversely positioned across a lower-end of the block, each wall including an upper main bearing journal for receiving a crankshaft;

a piston having a topside and backside disposed within each cylinder;

a crankshaft disposed within the upper main bearing journals;

a connecting rod interconnecting the crankshaft to each respective piston;

a cylinder head attached to the upper end of the bank of cylinders such that a combustion chamber is defined between the topside of each piston, the cylinders, and the cylinder head;

an oil sump having a flange attached to an opening in the lower-end of the engine, the opening exposed to an internal cavity of the engine;

an air intake manifold in communication with each combustion chamber; and an internal boost system integrated into the engine comprising, a blanking plate installed between the opening of the lower-end of the engine and the flange of the oil sump;

a plenum chamber disposed within the oil sump having an exit flange disposed through a side of the oil sump;

at least one one-way valve disposed through the blanking plate adapted to allow compressed air flow into the plenum chamber;

a plurality of one-way valves disposed through the lower-end of the engine to allow fresh air to be drawn internally into the engine;

a fresh air manifold in communication with the plurality of one-way valves disposed through the lower-end of the engine; and an internal boost supply pipe in communication with the plenum chamber exit flange and an air intake manifold of the engine;

wherein backsides of pistons, lower main journal walls from the lower-end of the engine, and a topside of the blanking plate form an internal compression chamber within the lower-end of the engine for each respective piston;

wherein fresh air is drawn into a respective internal compression chamber for each respective piston when each piston is moved upward and compressed by the backside of the piston when the piston is pushed downward; and wherein the compressed air flows through a respective one of the plurality of one-way valves into the plenum chamber, flows through the internal boost supply pipe, and then flows into the air intake manifold to provide a boost in pressure within compression chambers of the engine.

17. The system of claim 16, wherein the engine is a V-configured engine comprising one of a V-6, V-8, V-10 and V-12.

18. The system of claim 16, wherein the internal combustion engine is an in-line configured engine.

19. The system of claim 16, wherein the blanking plate is integrally formed to the oil sump.

20. The system of claim 16, wherein the blanking plate includes oil drain passages internally disposed within the plate for draining oil into the oil sump.

21. The system of claim 16, wherein the engine includes a unitary lower main journal plate adapted to mount to the lower-end of the engine, the lower main journal plate defined by a generally upright perimeter wall conforming to the lower-end of the block, and lower journal walls transversely positioned across the journal plate, each wall including a semicircular lower main bearing journal for receiving a crankshaft.

22. The system of claim 16, the unitary lower main journal plate including a lower main journal bearing journal oiling system having an oil supply passage to each journal and a return passage from each journal disposed internally within the unitary main journal plate.

23. The system of claim 16, wherein the engine lubrication system utilizes a wet sump system.

24. The system of claim 16, further including a dry sump lubrication system.

25. The system of claim 24, wherein the dry sump lubrication system is adapted scavenge oil from the oil sump.

26. The system of claim 25, wherein the dry sump lubrication system is adapted to scavenge oil from downstream the collector plenum.

27. The system of claim 16, wherein the one-way valves are reed valves.

28. The system of claim 16, further including a check-valve downstream of the exist flange to prevent backflow into the plenum chamber.

29. The system of claim 16, further including a first oil separator baffle positioned upstream the at least one-way valve disposed through the blanking plate.

30. The system of claim 16, further including a second oil separator baffle for removing pooling oil from the plenum chamber.

* * * * *